United States Patent [19]

Foley et al.

[11] Patent Number: 4,994,147

[45] Date of Patent: Feb. 19, 1991

[54] PHOTOGRAPHIC REFLECTION PRINT MATERIAL WITH IMPROVED KEEPING PROPERTIES

[75] Inventors: Francis J. Foley, Spencerport; Alberto M. Martinez; William A. Mruk, both of Rochester, all of N.Y.

[73] Assignee: Eastman Kodak Company, Rochester, N.Y.

[21] Appl. No.: 560,498

[22] Filed: Jul. 25, 1990

Related U.S. Application Data

[63] Continuation-in-part of Ser. No. 488,544, Mar. 5, 1990, abandoned.

[51] Int. Cl.[5] ..... D21H 19/10

[52] U.S. Cl. ..... 162/137; 162/183; 162/184; 162/185; 162/169; 162/158; 162/181.4; 162/181.2; 427/326; 427/391

[58] Field of Search ..... 162/199, 184, 185, 186, 162/181.4, 86, 158, 135, 136, 137, 179; 428/537.5, 537.7, 513; 427/326, 391, 395

[56] References Cited

U.S. PATENT DOCUMENTS

| | | | |
|---|---|---|---|
| 4,288,287 | 9/1981 | Miyama et al. | 162/135 |
| 4,335,184 | 6/1982 | Miyamoto et al. | 428/342 |
| 4,504,576 | 3/1985 | Kemme | 430/538 |
| 4,508,751 | 4/1985 | Tamagawa et al. | 427/44 |
| 4,675,245 | 6/1987 | Von Meer | 428/328 |

FOREIGN PATENT DOCUMENTS 63-173045 7/1988 Japan .

*Primary Examiner*—David L. Lacey
*Assistant Examiner*—P. L. Hailey
*Attorney, Agent, or Firm*—Robert A. Gerlach

[57] ABSTRACT

A method of making a photographic paper support having improved raw stock keeping characteristics by an internal acid sizing step and an external alkaline sizing step to achieve a water extractable pH of from 6 to 9.5.

13 Claims, No Drawings

PHOTOGRAPHIC REFLECTION PRINT MATERIAL WITH IMPROVED KEEPING PROPERTIES

This is a continuation-in-part of application Ser. No. 488,544, filed Mar. 5, 1990, now abandoned.

BACKGROUND OF THE INVENTION

1. Field of the Invention

This invention relates to reflection print material for photographic images and more particularly to paper support for photographic light sensitive elements and the method of preparing the same.

In the preparation of paper supports for use in photographic applications and particularly color negative-positive papers, a commercial method of preparation includes the internal acid sizing of the paper utilizing compounds such as stearic acid and the like. Such papers when employed in photographic applications provide excellent resistance against aqueous solutions and do not oxidize thereby providing excellent brightness and whiteness stability of the resulting paper and photographic images developed on the paper.

For many photographic applications the paper support is coated with a hydrophobic polyolefin in order to render the paper less susceptible to the various aqueous solutions through which the paper is passed during development. The various layers, including the light-sensitive emulsion layers, are applied to the polyolefin coated paper.

The polyolefin coated paper support is converted into light sensitive print elements for use in photographic applications in manners known and commonly used in the art by the application of one or more silver halide emulsion layers and, optionally, subbing layers, interlayers such as, tie layers, overcoat layers and the like which provide desired physical and/or sensitometric properties in the photographic material.

Photographic materials, such as briefly described above, are known to exhibit changes in their sensitometric properties on storage. The passage of time, exposure to heat, and/or the exposure to high humidity conditions, can cause deterioration in the material which is evidenced as an increase of minimum density (referred to as fog) after processing to provide a viewable image. This characteristic is commonly referred to as "raw stock keeping".

It has been learned through tests that the raw stock keeping characteristics of internally acid-sized photographic papers having built thereon the necessary layers to convert the paper support into a photographic print material are very satisfactory as the minimum density of such materials does not increase substantially over storage periods. However, when the acid-sized paper is first coated with a polyolefin layer prior to building the photographic layers thereon, the raw stock keeping characteristics diminish dramatically. That is, for such structures, the minimum density increases substantially over periods of time in storage. This problem has been observed to be even more acute where the silver halide employed in the emulsion layer is silver chloride or has a high silver chloride content. With the advent of rapid processing apparatus, which includes shorter development, washing and drying cycles, higher chloride content silver halides are desirable because of their ability to be processed at increased speeds. While it is not understood why the presence of a polyolefin layer between the paper support and the remaining layers of the photographic print material would have an influence upon the raw stock keeping of acid-sized papers, it is desirable to provide an acid-sized paper support coated with a polyolefin layer which does not suffer these disadvantages.

SUMMARY OF THE INVENTION

There is provided, in accordance with this invention, a photographic paper support having improved raw stock keeping characteristics by a method including the steps of internally sizing a paper with an acid-sizing agent, externally sizing the paper with an alkaline aqueous medium to achieve a water extractable pH of the completed paper of from 6 to 9.5 and coating the paper with a polyolefin resin. That is, the paper is prepared in accordance with normal paper making techniques, commonly known in the art, internally sized with an acid material generally an aliphatic acid having from 8 to 22 carbon atoms or derivatives thereof where the stock slurry for the formation of the paper has a pH of from about 4 to about 5.5, adjusting the water extractable pH of the paper via a size press operation to a pH of from about 6 to about 9.5 and coating the paper with a polyolefin resin.

DESCRIPTION OF THE PREFERRED EMBODIMENTS

In accordance with this invention, there is provided a photographic print material and a method of preparation wherein a paper support is prepared by internally acid-sizing of the paper stock slurry at a pH of from about 4 to about 5.5, adjusting the pH of the paper such that the water extractable pH of the paper is from about 6 to about 9.5 and then coating the paper with a polyolefin resin. The pH of the paper is adjusted utilizing any suitable alkaline aqueous medium including for example, sodium hydroxide, sodium bicarbonate, potassium hydroxide, potassium bicarbonate, borax, dibasic and tribasic potassium phosphates, and the like. The treated paper should have a water extractable pH within limits set forth above and preferably from about 6.5 to about 8.5 and most preferably from 7 to 8. Then the paper is coated with a polyolefin resin such as homopolymers or copolymers of alpha-olefins including ethylene, propylene and the like, in accordance with procedures well known in the art of photographic papers making.

By "internal acid sizing" is meant that the aqueous pulp stock mixture containing the various ingredients used in the preparation of the paper, i.e., the furnish, in the mixing chest of the paper apparatus has added thereto mineral acids and/or aliphatic carboxylic acids or salts thereof at a pH of the aqueous mixture of from 4 to 5.5.

By "external sizing" is meant that the treatment with an alkaline material takes place either in-line in the paper making process when the web is dried to a water content of less than 10% by weight, preferably less than 5% by weight and most preferably of from about 2 to about 4% by weight or, after the paper is finished, for example, after the calendering step. In this second alternative, the paper is treated off-line in a size press.

The materials and methods of making supports used in the manufacture of photographic materials are widely known in the industry. Suitable pulps for the preparation of photographic papers include sulphite, Kraft or soda, cooked softwood, hardwood, rag, rope or jute. The pulps preferably should be bleached. The paper can also be prepared from partially esterified cellulose fibers such as described in U.S. Pat. Nos. 2,062,679 and 3,096,231. The pulps for the preparation of photographic fibers may also include blends of wood cellulose and suitable synthetic fibers such as blends of wood cellulose and polyethylene fibers. The fibers are slurried in accordance with a known paper making technique and at this point, they are mixed with the various ingredients other than the fibers, such as, disclosed in U.S. Pat. Nos. 3,096,231; 3,592,731; 4,042,398 and 4,794,071, incorporated herein by reference, in addition to the internal acid sizing agent, such as, for example, stearic acid, sodium stearate acid, aluminum stearate, other aliphatic C8 through C22 carboxylic acids or derivatives thereof such as salts and the like to prepare an acid slurry having a pH of approximately 4 to 5.5.

The internal acid sizing preferably occurs by adding sodium stearate to the stock system at a point of high turbulance. Aluminum chloride or aluminum sulfate (Alum) is next added in a molar amount of Al: stearate of at least 1:1. Molar amounts higher than 1:1 are generally required to account for the presence of dry strength resins and other anionic materials. The pH of the aqueous stock system is from 4 to 5.5 preferably from 4 to 4.8 and most preferably from 4.2 to 4.5.

Other ingredients as indicated above such as fillers, for example, clays or pigments, such as titanium dioxide, wet strength resins, for example, amino-aldehyde or polyamide epichlorohydrin resins, dry strength agents including starches and the like are incorporated at this stage of preparation. The slurry is applied to the paper making screen which separates the water from the fibers and filler, at which point the web becomes self-supporting at a moisture content between 2–4%. The web is then passed through a conventional size press operation. The size press solution formulation can contain various polymeric binders such as starch, gelatin, and polyvinyl alcohol. Inorganic salts, such as sodium chloride, are present to provide conductivity for static discharge protection. Other sizing ingredients are added to the surface size formulation, such as alkyl ketene dimers to minimize the retention of photographic processing chemistry. The total content of the surface size can range from 50 to 100 pounds per ton of paper. As stated above, the treatment in accordance with this invention can be conducted at this stage while the web is still wet as defined above or after the paper has been finished, in either case by passing the web or paper through an aqueous bath containing the alkaline ingredient to achieve the water extractable pH indicated above as measured by TAPPI Method No. 435.

Subsequent to adjusting the water extractable pH of the paper support, the paper is coated with a polyolefin layer or layers preferably by extrusion from a hot melt as is known in the art. Prior to the polyolefin extrusion step, the paper is preferably treated with a corona discharge to improve the adhesion of the polyolefin to the paper support as described in U.S. Pat. No. 3,411,908. The polyolefin can be extruded with a wide temperature range, i.e., 150°–350° C., and speeds, e.g., about 60 m/min. to 460 m/min., depending on the particular intended application of the support. For many applications, preferred extrusion temperatures are about 310°–330° C. Optical brighteners stable at such temperatures, fillers, such as $TiO_2$, slip agents, antioxidants and the like, may be incorporated into the polyolefin. Under these conditions, the aforedescribed polyolefin coating, over which the silver halide emulsion is applied, is coated onto the paper base material in a coverage of from about 5 to about 200 g/m$^2$, at a uniform thickness ranging from about 5 to 200 μm. About the same coverage of clear polyethylene coating preferably is applied to the side of the paper base material opposite to the pigmented polyolefin coating.

The various layers to convert the paper support into a light reflecting photographic print material, such as silver halide emulsion layers, subbing layers, interlayers and overcoat layers are provided on to the polyolefin coated paper support. The silver halide emulsions employed in the present invention preferably comprise silver chloride grains which are at least 80 mole percent silver chloride and the remainder silver bromide. The silver chloride is preferably present in an amount of at least 90 mole percent and most preferably in an amount of at least 95 mole percent because of the improved speed in processing of the print material.

The silver halide emulsions comprise vehicles conventional in the art. Preferred vehicles are hydrophilic colloids which can be employed alone or in combination with hydrophobic materials. Preferred hydrophilic colloids are gelatin, for example, alkali-treated gelatin or acid-treated gelatin, and gelatin derivatives such as acetylated gelatin and phthalated gelatin.

The silver halide emulsions can be chemically and spectrally sensitized as is common in the art. The emulsions, or other layers of the material, can contain stabilizers, antifoggants, and other components intended to prolong the useful life of the material prior to exposure or of the photographic image obtained after development.

The material will commonly contain one or more dye-forming couplers which will provide the final viewable image. However, other means of forming a viewable image can be employed.

The material will typically contain additional layers, such as subbing layers to improve adhesion to the support and interlayers and overcoat layers to separate and protect the sensitive layers and to carry stabilizers, filter dyes and the like.

Further details of the components of the photographic reflection print material, the way they are prepared, and how they are processed to obtain a viewable image are provided in Research Disclosure, Nov. 1979, Item No. 18716, published by Kenneth Mason Publications, Ltd., The Hold Harbouraster's, 8 North Street, Emsworth, Hampshire P010 7DD, England and from Atwell U.S. Pat. No. 4,269,927, issued May 26, 1981.

The following examples are intended to further illustrate this invention.

EXAMPLE 1

A 9000 pound mixture of 35% bleached softwood sulfite and 65% bleached hardwood Kraft pulps were dispersed in 18,000 gallons of water containing 38 pounds of an optical brightener and refined through a double disc refiner and a Jordan. To this stock slurry several functional chemicals were added continuously to obtain optical, wet, and dry strength as well as sizing properties for the desired end use of photographic paper. These chemicals are commercially available and sold under the trademark Kymene and Accostrength, and under generic names like stearic acid, aluminum chloride, and titanium dioxide. The head box stock slurry pH is adjusted to 4.3 via the addition of hydrochloric acid. A paper sheet is formed on a paper machine, and the associated water is removed from the web. The web is then passed through a conventional size press containing a surface size solution of starch and salt. The web is then dried and calendered to achieve the desired surface qualities for photographic print paper.

EXAMPLE 2

(a) (control) A paper is prepared in accordance with the general procedure set forth in Example 1. The water extracted pH of the paper is 5.7.

(b) (comparison) The paper in Example 2(a) is treated, prior to the application of the polyethylene, in an off-line size press operation by passing it through an aqueous solution of 1.0 percent sulfuric acid. The water extracted pH of this paper is 5.1.

(c) (comparison) Example 2(b) is repeated except that the aqueous solution contains 0.5 percent of sulfuric acid. The water extracted pH of the paper is 5.3.

(d) (comparison) Example 2(b) is repeated except that the aqueous solution contains 0.1 percent of sulfuric acid. The water extracted pH of this paper is 5.5.

(e) (comparison) Example 2(b) is repeated except that an aqueous solution containing sodium bicarbonate at 2 weight percent is used instead of the sulfuric acid solution. The water extracted pH of the paper is 6.3.

(f) (comparison) Example 2(e) is repeated except that the aqueous solution contains 4 weight percent of sodium bicarbonate. The water extracted pH of this paper is 7.1.

(g) (comparison) Example 2(e) is repeated except that the aqueous solution contains 8 weight percent of sodium bicarbonate. The water extracted pH of this paper is 7.7.

(h) (comparison) Example 2(e) is repeated except that the aqueous solution contains 12 weight percent of sodium bicarbonate. The water extracted pH of this paper is 7.8.

Each of the supports 2(a–h) is sensitized in accordance with Example 4 (hereinafter), incubated and developed and the change in minimum density (D-min) recorded. The water extractable pH as measured by TAPPI Method No. 435 and the change in minimum density (raw stock keeping) after incubation at 120° F. and 50 percent relative humidity for 2 weeks and 3 weeks are presented in Table 1.

TABLE 1

| | Water Extractable Paper | Density Change (D-min) Incubation Time | | | | | |
|---|---|---|---|---|---|---|---|
| | | 2 weeks | | | 3 weeks | | |
| Example 2 | pH | R | G | B | R | G | B |
| a(control) | 5.7 | .004 | .014 | .037 | .006 | .024 | 047 |
| b(comparison) | 5.1 | .005 | .006 | .055 | .026 | .026 | .057 |
| c(comparison) | 5.3 | .004 | .005 | .046 | .002 | .020 | .054 |
| d(comparison) | 5.5 | −.003 | .004 | .042 | .001 | .022 | .056 |
| e(comparison) | 6.3 | .023 | .011 | .049 | .018 | .011 | .068 |
| f(comparison) | 7.1 | .010 | .002 | .049 | .018 | .005 | .071 |
| g(comparison) | 7.7 | .008 | .004 | .060 | .012 | .008 | .073 |
| h(comparison) | 7.8 | .006 | .001 | .049 | .023 | .011 | .070 |

Table 1 clearly demonstrates that the raw stock keeping of a photographic element built on an internally acid sized paper support without a polyolefin layer does not change to a large degree even if the water extractable pH is altered by an alkaline treatment within the parameters indicated.

EXAMPLE 3

The paper supports prepared in accordance with Examples 2(a–h) are each treated by corona discharge and then a layer of polyethylene is extruded on to each side of the paper in a coverage of 26 g/m$^2$ on the surface to be sensitized and 28 g/m$^2$ on the opposite surface. The supports are sensitized as described in Example 4 and subjected to the same incubation periods as in Examples 2(a–h). The data is reported in Table 2.

TABLE 2

| | Water Extractable Paper | Density Change (D-min) Incubation Time | | | | | |
|---|---|---|---|---|---|---|---|
| | | 2 weeks | | | 3 weeks | | |
| Example 3 | pH | R | G | B | R | G | B |
| a(control) | 5.7 | — | — | — | .107 | .071 | .110 |
| b(comparison) | 5.1 | .083 | .053 | .090 | .165 | .108 | .169 |
| c(comparison) | 5.3 | .102 | .062 | .108 | .214 | .144 | .213 |
| d(comparison) | 5.5 | .073 | .040 | .077 | .155 | .093 | .158 |
| e | 6.3 | .029 | .029 | .044 | .069 | .051 | .087 |
| f | 7.1 | .015 | .016 | .033 | .032 | .029 | .047 |
| g | 7.7 | .012 | .013 | .033 | .023 | .015 | .047 |
| h | 7.8 | .017 | .015 | .028 | .016 | .011 | .042 |

Table 2, unlike Table 1 clearly and unexpectedly demonstrates that by practicing in accordance with the invention, a polyolefin layer being present, the change in D-min is greatly reduced when compared to papers having a lower pH.

EXAMPLE 4

To each of the supports prepared in Examples 1, 2 and 3 is coated in order the following layers, layer 1 being adjacent to the support:

1. Blue sensitive layer:
   Chemically and blue spectrally sensitized monodisperse silver chloride negative emulsion (0.34 g Ag/m$^2$) and yellow-dye forming coupler Y (1.08 g/m$^2$) in di-n-butyl phthalate coupler solvent (0.27 g/m$^2$), gelatin (1.51 g/m$^2$)
2. Interlayer:
   Gelatin (0.76 g/m$^2$)
3. Green sensitive layer:
   Chemically and green spectrally sensitized monodisperse silver chloride negative emulsion (0.27 g Ag/m$^2$) and magenta-dye forming coupler M (0.42 g/m$^2$) in di-n-butyl phthalate coupler solvent (0.22 g/m$^2$), gelatin (1.24 g/m$^2$)
4. UV absorbing layer:
   A mixture of hydroxyphenylbenzotriazoles (0.38 g/m$^2$), gelatin (0.74 g/m$^2$)
5. Red sensitive layer:
   Chemically and red spectrally sensitized monodisperse silver chloride negative emulsion (0.18 g Ag/m$^2$) and cyan-dye forming coupler C (0.42 g/m$^2$) in di-n-butyl phthalate coupler solvent (0.24 g/m$^2$), gelatin (1.08 g/m$^2$)
6. UV absorbing layer:
   A mixture of hydroxyphenylbenzotriazoles (0.38 g/m$^2$), gelatin (0.74 g/m$^2$)
7. Overcoat layer:
   Gelatin (1.35 g/m$^2$)

The layers 1 to 7 were hardened with bis(vinylsulfonyl)methyl ether at 1.8% of the total gelatin weight. Coupler identifications are:

C=Cyan dye forming coupler: 2-(α-(2,4-di-tert-amylphenoxy)butyramido)-4,6-dichloro-5-ethyl phenol M=Magenta dye forming coupler: 1-(2,4,6-trichlorophenyl)-3-(2-chloro-5(α-(4-hydroxy-3-tert-butylphenoxy)-tetradecanoamido)anilino)-5-pyrazolone Y=Yellow dye forming coupler: α-(4-(4-benzyloxyphenyl-sulfonyl)phenoxy)-α-(pivalyl)-2-chloro-5-(γ-(2,4-di-t-amylphenoxy)butyramido)acetanilide Each element having layers as described in Example 4 on the supports of Examples 1, 2 and 3 are kept at 120° F. and 50% relative humidity for various periods of time and then exposed and processed at 35° C. in a three-step process of colored development (45 seconds), bleach-fix (45 seconds), and stabilization (90 seconds) followed by drying (60 seconds) at 60° C. After processing the Status A blue, green and red densities of each incubated coating along with those of its non-incubated control are read and the changes in D-min (no exposure density) are determined.

The formulations for the above processing solutions are as follows:

| | |
|---|---|
| (1) Color developer: | |
| Lithium salt of sulfonated polystyrene (30% by wt) | 0.25 mL |
| Triethanolamine | 11.0 mL |
| N,N diethylhydroxylamine (85% by wt) | 6.0 mL |
| Potassium sulfite (45% by wt) | 0.5 mL |
| Color developing agent 4 (N-ethyl N-2 methanesulfonylaminoethyl) 2 methyl phenylenediaminesesquisulfate monohydrate | 5.0 g |
| Kodak Ektaprint 2 Stain-Reducing Agent (a stilbene material commercially available from Eastman Kodak Co.) | 2.3 g |
| Lithium sulfate | 2.7 g |
| Potassium chloride | 2.5 g |
| Potassium bromide | 0.025 g |
| Kodak Anti Cal No. 5 (an organic phosphonic acid material commercially available from Eastman Kodak Co.) | 0.8 mL |
| Potassium carbonate | 25.0 g |
| Water to total of 1 liter, pH adjusted to | 10.12 |
| (2) Bleach-fix: | |
| Ammonium thiosulfate | 58.0 g |
| Sodium sulfite | 8.7 g |
| Ethylenediaminetetraacetic acid ferric ammonium salt | 40.0 g |
| Acetic acid | 9.0 mL |
| Water to total 1 liter, pH adJusted to | 6.2 |
| (3) Stabilizer: | |
| Sodium citrate | 1.0 g |
| Dearside (a biocide produced by Rohm and Haas) | 45.0 ppm |
| Water to total 1 liter, pH adjusted to | 7.2 |

EXAMPLE 5

(a) (control) A paper is prepared in accordance with the general procedure set forth in Example 1.

(b) The paper of Example 5(a) is treated, prior to the application of the polyethylene, in an off-line size press operation by passing it through an aqueous solution of 8 percent sodium bicarbonate.

(c) Example 5(b) is repeated except a 5 percent aqueous solution of sodium hydroxide is used in place of the sodium bicarbonate solution.

The three papers of Examples 5(a), 5(b) and 5(c) are coated with polyethylene in accordance with Example 3 and sensitized in accordance with Example 4. A portion of each sample is stored for 2 weeks and 3 weeks at 120° F. and 50 percent relative humidity and for 6 months at 78° F. and 50 percent relative humidity, developed and the D-min measured and compared with a non-incubated sample.

The change in D-min, which is the measure of raw stock keeping is set forth in Table 3

TABLE 3

| Example | Density Change D-min | | | | | | | | |
|---|---|---|---|---|---|---|---|---|---|
| | 2 weeks | | | 3 weeks | | | 6 months | | |
| | R | G | B | R | G | B | R | G | B |
| 5(a) (control) | .056 | .073 | .064 | .149 | .217 | .145 | .045 | .037 | .051 |
| 5(b) | .014 | .017 | .025 | .042 | .049 | .050 | .013 | .012 | .016 |
| 5(c) | .006 | .019 | .033 | .023 | .029 | .046 | .012 | .013 | .020 |

EXAMPLE 6

(a) A paper is prepared in accordance with the general procedure set forth in Example 1. The water extracted pH of this paper is 5.2.

(b) The procedure of Example 6(a) is repeated except 0.2 percent by weight of sodium bicarbonate is added to the surface size solution containing starch and salt. The water is extracted pH of this paper is 5.5.

(c) The procedure of Example 6(b) is repeated except 0.4 percent of sodium bicarbonate is added to the surface size solution. The water extracted pH of this paper is 5.9.

(d) The procedure of Example 6(b) is repeated except 0.9 percent of sodium bicarbonate is added to the surface size solution. The water extracted pH of this paper is 7.9.

These paper supports are treated by corona discharge and then layers of polyethylene are extruded on each side of the paper. The supports are sensitized following the general procedure given in Example 4 except that silver chlorobromide emulsions, containing more than 50 percent of bromide, are used. After incubation and exposure the coatings are processed using commercially available Kodak Ektaprint 2 chemicals. The change in minimum density after incubation for 6 weeks at 120° F. and 50% relative humidity are presented in Table 4.

TABLE 4

| Example 6 | Water Extractable Paper pH | Density Change (D-min) | | |
|---|---|---|---|---|
| | | R | G | B |
| a(control) | 5.2 | .016 | .035 | .041 |
| b(comparison) | 5.5 | .009 | .029 | .031 |
| c(comparison) | 5.9 | .010 | .032 | .029 |
| d | 7.9 | .007 | .020 | .022 |

It should be understood that any of the alkaline materials mentioned above may be employed in place of those specifically used in these examples to achieve the water extractable pH set forth and the improved raw stock keeping characteristics reported.

Occasionally, depending on the quality of the water employed, i.e., should the water contain calcium ions, an unwanted precipitate (calcium carbonate) is observed in the size press when using bicarbonate to adjust the pH. This precipitate can be avoided by any suitable technique, such as, utilizing water free of calcium ions, for example, demineralized water, or by tying-up the calcium ions with known chelating agents. An alternative method is to depress the pH by the addition of acid to reduce the amount of precipitate formed.

The invention has been described in detail, with reference to preferred embodiments thereof, but it will be understood that modifications can be effected within the spirit and scope of the invention.

What is claimed is:

1. In the method of making a photographic paper support including the steps of internally sizing the aqueous pulp paper furnish with an acid sizing agent, forming the paper from the furnish, drying the paper and coating the paper on each surface with a polyolefin resin the improvement which comprises externally sizing the paper prior to application of the polyolefin coating with an aqueous alkaline medium to achieve a water extractable pH of the paper of from 6 to 9.5.

2. The method of claim 1 wherein the paper is externally sized so that the water extracted pH is from 6.5 to 8.5.

3. The method of claim 1 wherein the water extracted pH is from 7 to 8.

4. The method of claim 1 wherein the external sizing step is conducted in-line in the steps of making the paper when the paper contains less than 10 percent by weight of water.

5. The method of claim 4 wherein the water content is less than 5 percent by weight.

6. The method of claim 4 wherein the water content is from about 2 to about 4 percent by weight.

7. The method of claim 1 wherein the external sizing step is conducted off-line after the paper is formed and before it is coated.

8. The method of claim 1 wherein the pH of the aqueous pulp furnish is from 4 to 5.5.

9. The method of claim 8 wherein the pH of the aqueous pulp furnish is from 4 to 4.8.

10. The method of claim 8 wherein the pH of the aqueous pulp furnish is from 4.2 to 4.5.

11. The method of claim 1 wherein the aqueous alkaline medium is an alkali metal base.

12. The method of claim 11 wherein the alkali metal base is sodium or potassium.

13. The method of claim 11 wherein the alkali metal base is sodium bicarbonate, potassium bicarbonate, sodium hydroxide, or potassium hydroxide.

* * * * *